US005499837A

United States Patent [19]

Hale et al.

[11] Patent Number: 5,499,837

[45] Date of Patent: Mar. 19, 1996

[54] SWIVELABLE MOUNT FOR SNOWBOARD AND WAKEBOARD

[76] Inventors: Joseph P. Hale; Robert H. Whyte, both of 3003 Arapahoe St., Denver, Colo. 80205

[21] Appl. No.: 509,437

[22] Filed: Jul. 31, 1995

[51] Int. Cl.[6] ..... A63C 9/00

[52] U.S. Cl. ..... 280/607; 280/618; 280/14.2

[58] Field of Search ..... 280/607, 617, 280/618, 14.2, 14.1, 629, 630, 633, 636; 441/70

[56] References Cited

U.S. PATENT DOCUMENTS 5,277,635 1/1994 Gillis ..... 441/70

*Primary Examiner*—Richard M. Camby
*Assistant Examiner*—Frank B. Vanaman
*Attorney, Agent, or Firm*—Charles C. Corbin

[57] ABSTRACT

A swivelable mount for the boot bindings of a snowboard or the like, including a low profile housing with walls enclosing a cylindrical cavity, the housing bottom having a bore concentric with and smaller in diameter than the cavity, the bore being surrounded by an upward-facing annular surface, the housing top adapted for the mounting of a boot binding. A circular member for rotatably mounting the housing is secured to the snowboard and has a stem journaled in the housing bore and a larger diameter cap fitting in the housing cavity. The cap provides a downward-facing annular flange positioned opposite the upward-facing annular surface of the housing, and prevents upward movement of the housing from the snowboard. A circular locking plate rotatably mounted in the cavity above the top of the housing mount has a top surface characterized by a plurality of radially extending undulations, and the top wall of the housing cavity is provided with a similar undulating surface. The two undulating surfaces are slidably engaged. The plate has a first rotational position where the two undulating surfaces mesh, corresponding to an unlocked, rotatable condition of the housing. A lever, mounted to the housing can rotate the locking plate, moving the two undulating surfaces from a meshed position to an un-meshed position, resulting in relative axial movement of the housing, engaging the opposing annular surfaces and preventing housing rotation.

9 Claims, 4 Drawing Sheets

SWIVELABLE MOUNT FOR SNOWBOARD AND WAKEBOARD

BACKGROUND OF THE INVENTION

1. Field of the Invention

The present invention relates to binding systems for snowboards, and more particularly to a snowboard binding mount that allows swiveling of the binding for rapid angular adjustment relative to the centerline of the snowboard.

2. Description of the Prior Art

In recent years, there has been a tremendous growth of the sport of snowboarding, and concomitantly more attention has been given to some of the nagging problems experienced by snowboarders. A typical snowboard is essentially a single, wide ski that has fore and aft boot bindings that support both feet at a substantial angle with respect to the centerline of the snowboard. This cross-orientation of the bindings allows the rider to assume a side-forward stance, which is the necessary anatomical positioning for optimal in-use control of the snowboard. While this side-forward positioning is optimal for in-use control on the ski-run, it can result in problems for the snowboarder during non-snowboarding periods of use, such as when the snowboarder is maneuvering on flat terrain in the chairlift boarding area, and in maneuvering onto the lift chair and riding on the lift chair. Thus, it is a common and necessary practice for the snowboarder in such circumstances to disengage one boot, usually the aft boot, from its binding which allows the user to ride in what is termed "skate-board" style by propelling himself with his free foot. Problems result because the "skate-boarding" snowboarder who tries to assume a body-forward position during this time is compelled to hold his body in an unnatural and twisted position relative to the foot that is attached to the snowboard, which, besides being uncomfortable, exerts stress and strain on the knee joint which can damage the knee and aggravate existing knee problems. Because a comfortable body-forward position is prevented, the ability to have optimum visibility to both sides of the path of travel, is greatly hindered. In addition, the problem of undue stress and strain on the snowboarder's leg and knee can be experienced by the snowboarder during his ride in the chairlift when he attempts to hold the attached snowboard, with one foot attached, in a manner that does not interfere with his chairlift companion.

One apparent solution to the problem is to provide means that will allow at least one of the bindings to be rotated from the normal transverse angular position to a toe-forward position relative to the snowboard, during non-snowboarding use of the snowboard by the user. In this regard, it is noted that the prior art does show some examples of snowboard binding support mechanisms that will allow angular adjustment of the binding with respect to the snowboard centerline. In U.S. Pat. No. 5,236,216, for example, there is shown a fastening disk that can be clamped upon a binding-support plate that can be turned about a normal axis to the board. Several bolts must be loosened somewhat to allow the rotational position of the binding plate to be changed, then the bolts must be re-tightened. Similarly, in U.S. Pat. No. 5,261,689, a number of bolts through a hold-down plate for a rotatable binding-support plate must be loosened and then re-tightened in order to change the binding orientation. The system shown in U.S. Pat. No. 5,044,654 is somewhat of an improvement since only a single central bolt must be loosened and re-tightened. While the aforementioned binding support systems have their advantages, they all share a major drawback in not allowing angular adjustment of bindings to be made quickly, easily, and conveniently, because they require removal of the boot from the binding in each case, and the use of tools to tighten and loosen the bolts.

U.S. Pat. No. 5,354,088 recognizes some of the unique problems to snowboarders; however, the aforestated problem is not addressed. Although it does disclose a mechanism that permits a swiveling motion of the bindings, this twisting motion is merely incidental to a rotation required for quickly uncoupling a boot binding from the snowboard to facilitate transition to a "skate-boarding" mode of travel.

It is also noted that it is often desirable to make fine adjustments to the angular displacement of fore and aft binding within their generally transverse orientations in order to suit the particular preferred stance of an individual snowboarder. In this regard, the prior art does provide means to accomplish this, as mentioned above, but as also mentioned above, such bolt-manipulating techniques are quite inadequate where speed, convenience, and ease are concerned.

It is also noted with great interest that in the fast-emerging water sport of "wakeboarding" wherein a water skier uses a single board having fore and aft bindings at a cross-board orientation similar to that used in snowboarding, that there are occasions when the skier's side-forward anatomical configuration is not the optimum desirable one to have. For example, during launching from a stationary, partially submerged position, it would be extremely better to have the skier in a natural, body-forward position for better control, visibility, etc., rather than the "forced" side-forward stance required by conventionally oriented wakeboard bindings.

SUMMARY OF THE INVENTION

In view of the foregoing, it is a general object of the present invention to provide for a snowboarder, the capability of rapidly and easily changing the orientation of at least one of his bindings-attached feet from a transverse position to a toe-forward position, thereby enabling a natural position of the knee, foot, and leg during standing, walking, sitting, and "skate boarding".

Another object is to provide for a snowboarder, the capability of easily, quickly, and effectively, without disengaging one's feet from the snowboard, making fine adjustments to the angular orientation of the binding with respect to the centerline of the snowboard.

A related object is to provide snowboard users with substantially increased comfort and convenience during lift line and lift ride durations.

A still further object is to provide a way to substantially reduce the risk of harmful stress to the knee joints of snowboarders.

Yet a more particular object is to provide an ergonomically advanced locking system for a swivelable binding, featuring a latch handle that is easy to manipulate for locking and unlocking.

Yet another object is to provide for the wakeboarding enthusiast a toe-forward bindings position during launching, which orientation can be quickly and easily changed to a cross-board orientation during subsequent skiing.

These, and other objects and advantages are provided by the present invention of a swivelable mount and locking mechanism for the binding of a snowboard, wakeboard, or the like, including a swivelable housing having a top wall, side walls, and a bottom wall, and enclosing a vertically oriented, cylindrical cavity, said housing bottom having a bore concentric with and smaller than said cavity, and an annular flange extending radially from the bore and providing a generally upwardly-facing annular contact surface, and wherein the downwardly-facing top surface of the cavity is characterized by an array of radially extending undulations, and the upper part of the housing adapted to support a boot binding. There is a support member, concentric with the cavity for swivelably holding the housing, and it is stationarily affixed to the board, and it has an upper cap portion that is received within the cavity of the housing, and a cylindrical stem extending downwardly from the cap portion and journaled within the housing bore so as to allow rotation of the housing about the axis of the support member. The support member flange has a generally downwardly-facing annular contact surface that is disposed above the upwardly-facing annular contact surface of the housing and is engagable therewith.

Some ski board users prefer to lead with their left foot and others prefer their right foot, and accordingly it is a further object of the invention to provide a board user with the capability of making rapid rotational adjustment of the binding of a given board, as required to suit the desired lead foot preference.

The invention features a circular, rotatable pressure plate concentrically mounted within the cavity in the space above the upper surface of the support member, and its lower surface is slidably engagable with the support member upper surface,and the rotatable pressure plate features an upper surface characterized by an array of radially extending undulations which are slidably engagable with the aforementioned undulations of said cavity top surface, whereby the pressure plate has a first relative rotational position in which its undulations will substantially mesh with the complementary undulations of the cavity top wall. The rotatable pressure plate is a part of the unique system for locking and unlocking the housing against rotation relative to the support member and includes a quick-throw latch mounted to the housing for rotating the rotatable pressure plate from the above-referenced mesh position toward a position wherein the pressure plate is urged axially away from the upper surface of said cavity, which action is effective to move the housing upwardly relative to the support structure, which in turn causes the respective annular contact surfaces to be pressed into binding frictional engagement with each other so as to hold the housing against relative rotation. In order to free the housing for rotation, the latch is manipulatable to return the rotatable locking plate toward the position where it meshes with the top surface of the cavity. In one preferred embodiment, the opposing annular contact surfaces are fashioned to enhance their non-slip qualities, and there is a push-button mechanism for holding and releasing the latch from its lock position.

DETAILED DESCRIPTION OF THE INVENTION

Figure 1:
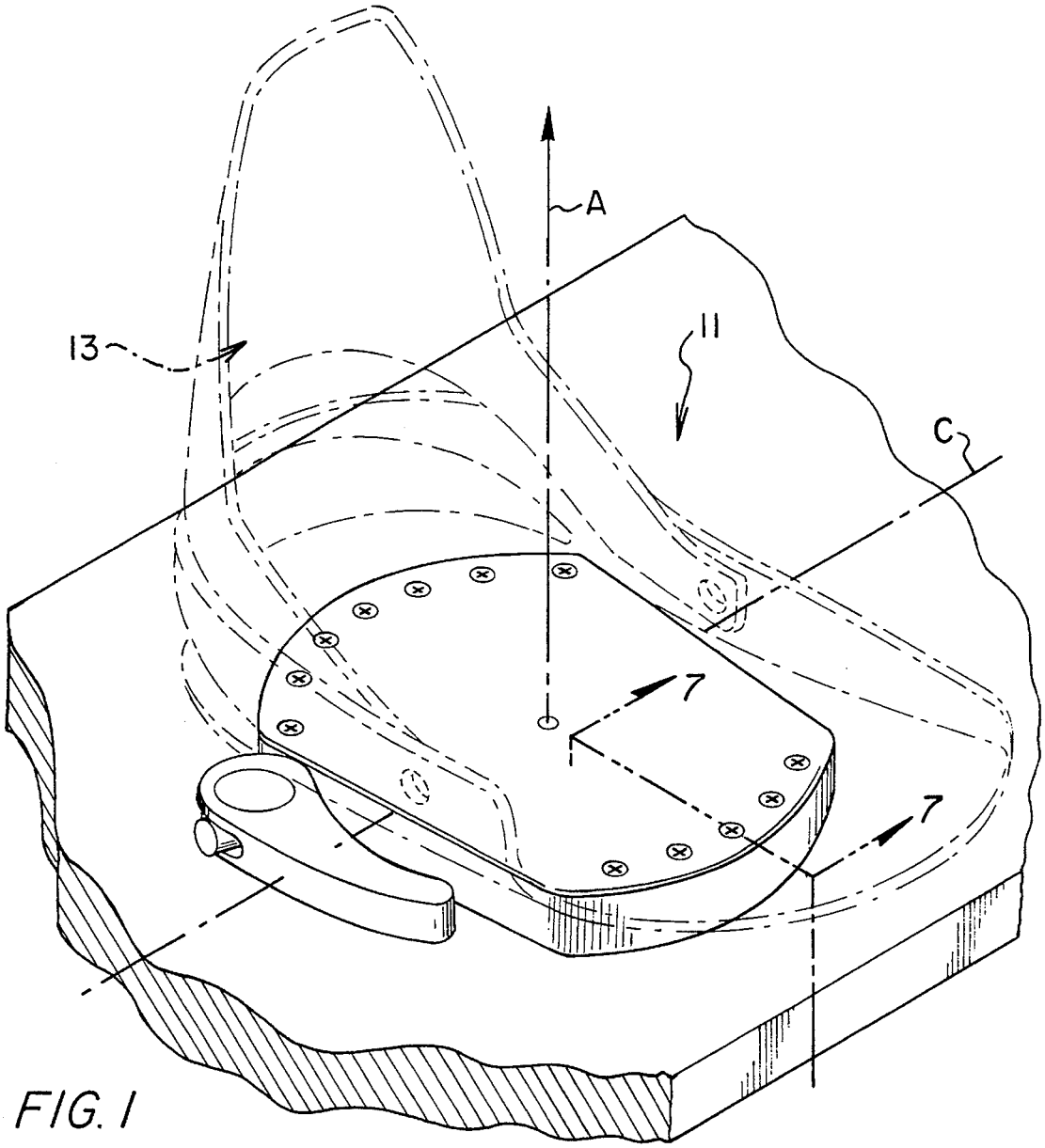
FIG. 1 is a perspective view showing a preferred embodiment of a swivelable binding mount and lock mechanism according to the present invention.

Referring now to the drawings, FIG. 1 shows a mount and related lock mechanism for allowing a boot shell 13 to swivel about an axis A, normal to a snowboard B, and for releasably locking it at any desirable angle with respect to the centerline C of the snowboard B. As FIG. 2 illustrates, the main components of device 11, a preferred embodiment of the invention, include a swivelable housing comprising a main body 15 and a cover plate 17, housing support structure for being stationarily secured to the snowboard and comprising support member 19 and mounting plate 21, a rotatable pressure plate 23, and finally a latch mechanism 25, mounted to main body 15 for rotating the rotatable pressure plate 23 in a manner to be described hereinafter.

Figure 2:
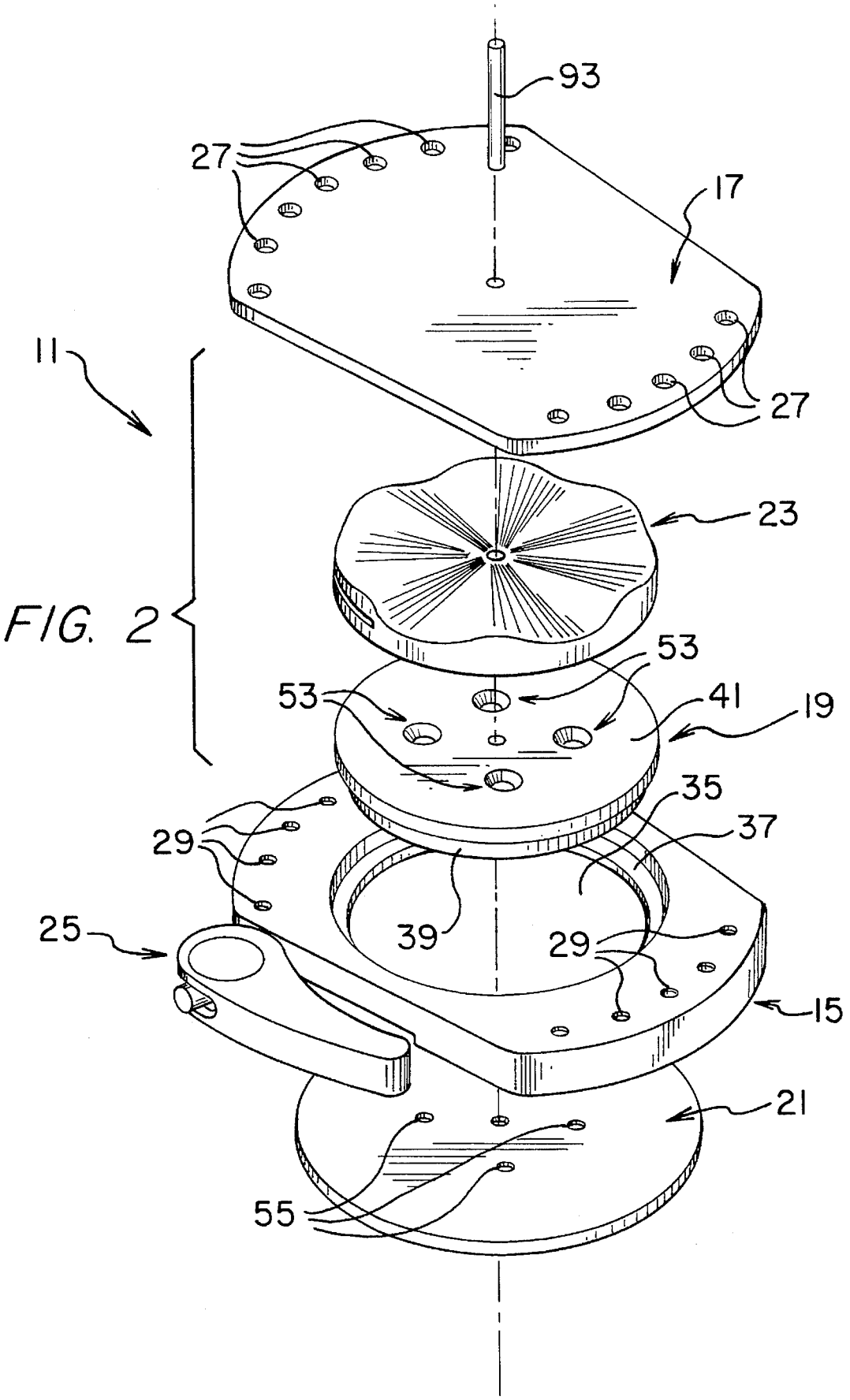
FIG. 2 is an exploded perspective view of the device of FIG. 1.
Figure 4:
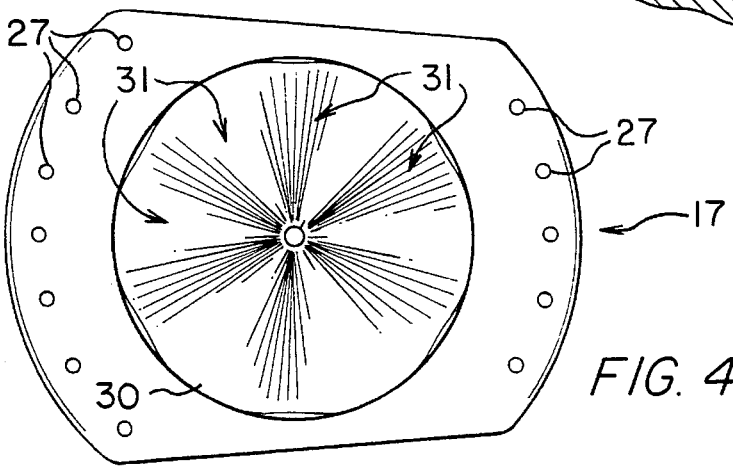
FIG. 4 is a bottom plan view of the cover plate for the housing of the device shown in FIG. 1.
Figure 5:
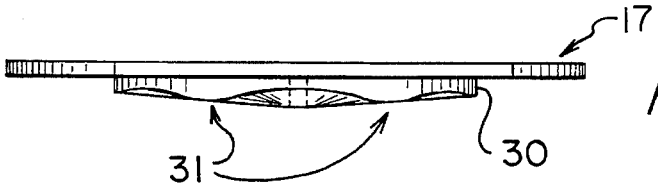
FIG. 5 is a side elevational view of the cover plate of FIG. 4.

As illustrated FIGS. 2, 4, and 5, the cover plate 17 has a number of holes 27 that are alignable with threaded bores 29 in the main body 15, for receiving suitable threaded fasteners to secure cover 17 to main body 15. When cover 17 is thusly attached, a relatively short-depth cylindrical cavity will be provided for receiving the upper part of the support member 19 as well as the rotatable pressure plate 23, in a manner to be described. As best shown in FIGS. 4 and 5, there is a molded circular projection from the bottom of the cover plate 17, and it features a surface that is somewhat tapered towards its center and characterized by a number of radially extending undulations 31, also somewhat tapered. In the preferred embodiment hereshown, there are six equispaced undulations, i.e. an array of six peaks and six valleys. It will become evident to those experienced in the art that the number of waves, their amplitude and curvature characteristics may vary in various embodiments of the invention, without departing from the invention as herein taught. It is to be noted that in the assembled unit, the circular projection 30 will become the ceiling or upper surface of the aforementioned housing cavity.

FIG. 2 shows that main body 15 has a cylindrical recessed portion with a bore 35 and an annular flange that provides an annular contact surface 37.

Figure 7:
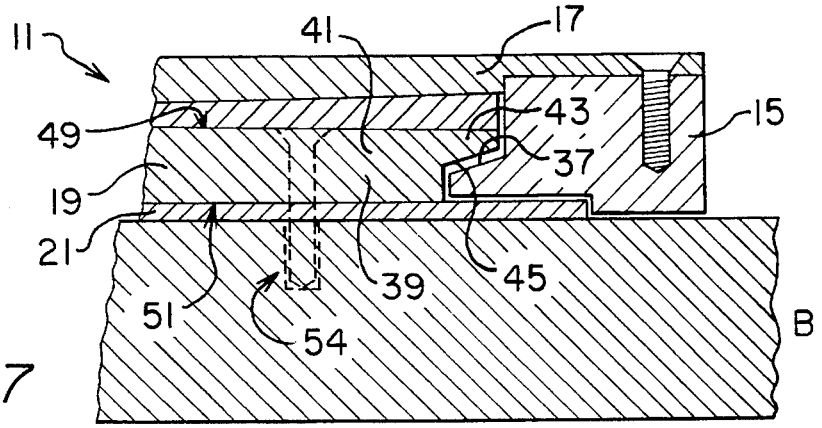
FIG. 7 is an enlarged sectional, partial view taken along the line 7—7 of FIG. 1.

Note from FIGS. 2 and 7 that the support member 19 has a lower, stem portion 39 that is journaled through the bore 35 and a cap portion 41 that fits within the body cavity, and FIG. 7 best shows how the cap portion 41 provides a radially extending flange 43 and a downward-facing annular contact surface 45 which is disposed adjacent the annular contact surface 37 in the assembled device. Support member 19 is seen to have a flat upper surface 49 and a flat lower surface 51. For reasons, to become evident, it is desirable that the opposing annular surfaces 37 and 45 be roughened, knurled, provided with radial microtoothing, or otherwise treated to enhance the non-slip qualities of these surfaces.

As suggested by FIGS. 2 and 7, the housing body 15 can be rotatably mounted to the snowboard B when the stem portion 39 of support member 19 is placed through housing bore 35, and threaded fasteners engaged through holes 53 in member 19 and holes 55 in plate 21 to engage holes 54 in the snowboard to firmly secure the support member 19 stationarily to the snowboard. Note from FIG. 7 how the mounting plate 21 resides in a recessed portion in the bottom of body 15. With the support 41 thusly installed, the body 15 will be swivelable about the vertical axis of support 19, and the juxtaposed annular surfaces will abut each other to limit upward movement of housing body 15 as is apparent from FIG. 7.

Figure 3:
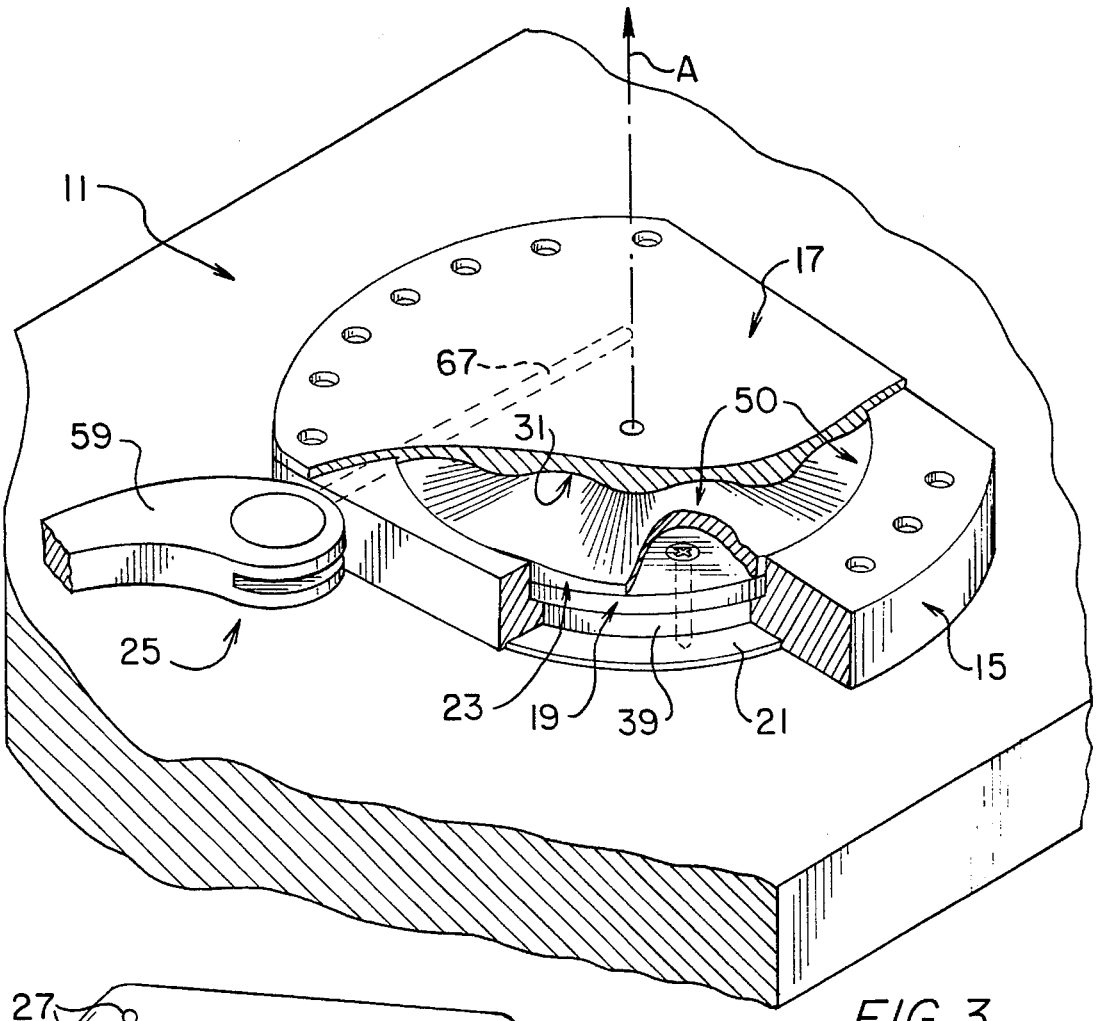
FIG. 3 is a partial sectional perspective view, with parts broken away for the sake of clarity, of the device of FIG. 1.

The rotatable locking plate 23, shown in FIG. 2, 3, and 7, has a flat bottom surface designed to slidably engage the top surface 49 of the support member 19, and features a top surface having undulations that complement the stationary undulations 31 of the cover plate 17 in number and configuration, the entire surface being somewhat tapered and sunken towards its center, and the plate 23 having a rotational position in which its undulations substantially mesh with the opposing undulations shown in FIGS. 4 and 5.

The above-mentioned opposing undulating surfaces are designed to slidably engage each other, and when one is rotated with respect to the other, it is intended that relative axial movement be generated, in the fashion of cam and cam follower.

Figure 6:
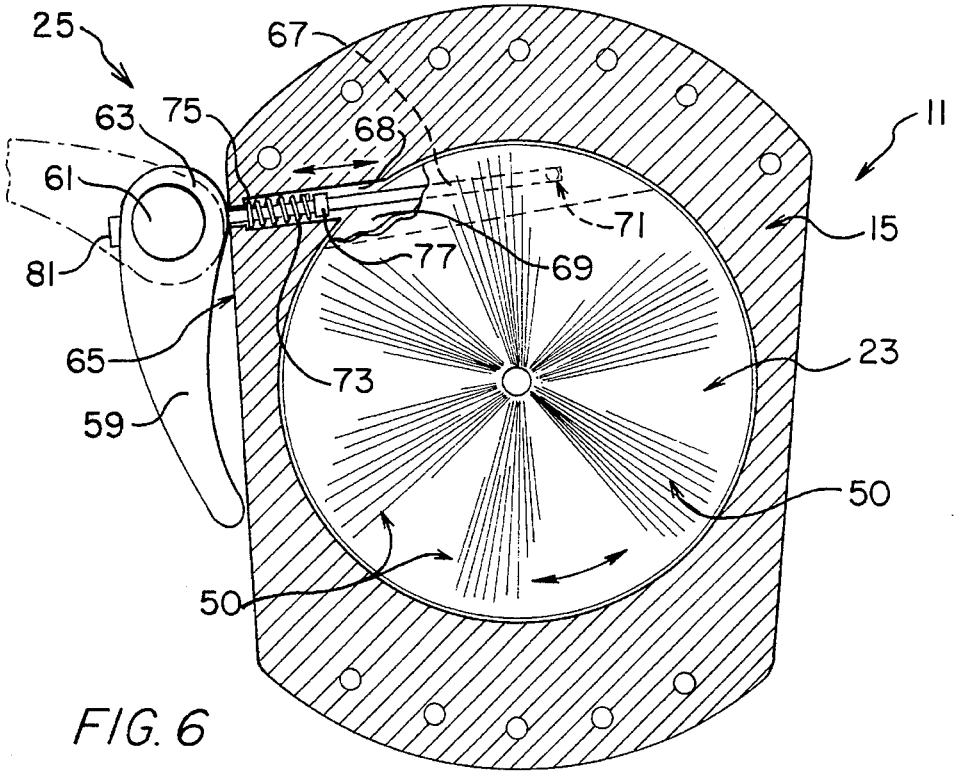
FIG. 6 is a sectional, top plan view illustrating the mechanism for rotating the locking plate of the invention.

FIG. 6 best shows how the rotatable locking plate 23, rotatably mounted in the main body 15, is drivable through a selected short amount of rotation by the latch mechanism 25. There is a cam lever 59 that is rotatably mounted to a hub 61 and including a cam portion 63 that slidably engages the side surface 65 of body 15 as shown, and a linking arm 67 has one end secured to hub 61 and the other end received through a slot 69 in plate 23, and pivotally connected to plate 23 with a connector pin 71. Note how a compression spring 73 has one end engaged with an annular shoulder 75 of passageway 68, the other end engaging a stop 77 to urge the arm 67 toward the right as viewed in FIG. 6. There is a release button mechanism, to be described, including button 81, for releasably holding the lever arm 59 in the position shown, whereby button 81 is depressible to allow lever 59 to be rotated toward the position shown in broken lines in FIG. 6 when the device 11 is used in a manner to be described.

Figure 9:
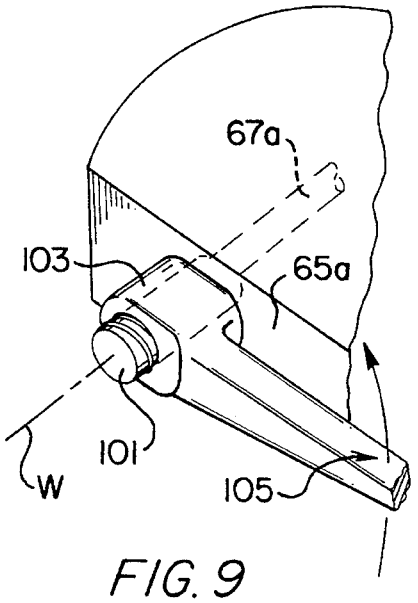
FIG. 9 is a partial, perspective view of a variant locking mechanism for the invention.

A cam lever 59 is used in the above-described embodiment; however, under the present invention, other means for rotating plate 23 are contemplated. For example, FIG. 9 shows a plate-turning mechanism that includes a threaded portion 101 extending from the end of linking arm **67*a* through a plain bore through housing wall 65*a*. The hub 103 of lever 105 is threadedly engaged by portion 101, the side of hub 103 slidably engaging the surface of wall 65*a*, and the pitch of the engaged threads is selected such that a 180° turn of lever 105 will move arm 67*a*** by the required amount.

Figure 8:
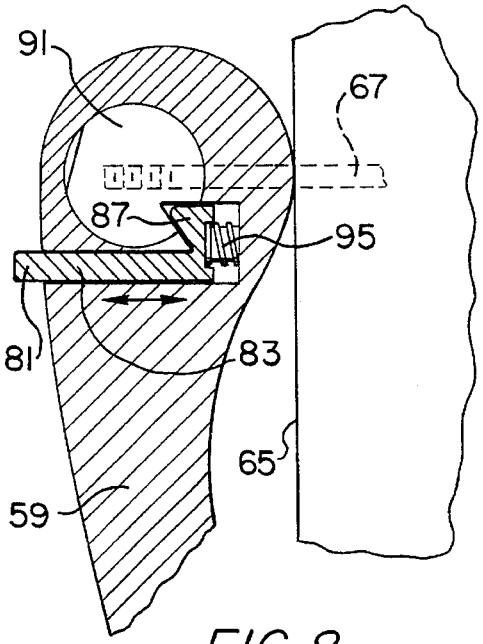
FIG. 8 is a partial, sectional view illustrating the release-button mechanism used in a preferred embodiment of the invention.

FIG. 8 illustrates the release mechanism operated by button 81, wherein button shaft 83 is slidably received in a channel 85 in the body of the lever 59, for movement in the direction shown by the arrows. A latch head 87 is designed to engage a recess 89 in the hub 91 to hold the lever 59 against rotation, and a spring 95 urges the latch head 87 toward engagement with hub 91. Button 81 can be depressed to disengage latch head 87, allowing lever 59 to be rotated.

Finally, it is noted that in the preferred embodiment, there is a center pin 93 that is journaled through the center hole of the rotatable plate 23 and having its lower end press fit in the center holes of support 19 and mounting plate 21, its upper end residing in the center hole of the cover plate 17. Thus, center pin 93 will serve as an axle that guides rotation of the rotatable pressure plate 23.

FIG. 3 shows the assembled device 11 with lever 59 released and rotated to a position wherein the device housing is unlocked to allow the device housing to swivel about axis A. Note that here, the latch mechanism 25 holds the rotatable plate 23 in a rotational position where its undulations 50 substantially mesh with the undulations 31 of cover plate 17. In order to lock the device housing against rotation, the lever 59 is rotated from the position shown in FIG. 3 to the position shown in FIG. 6., full rotation to this position tripping the release button mechanism to hold the lever 59 in that position. During the turning of lever 59, the cam portion 63 will engage surface 65, causing linking arm 67 to be pulled outwardly thereby rotating the rotatable plate 23 from its mesh position described above.

While there has been described a particular embodiment of the invention, it will be obvious to those skilled in the art that various changes and modifications may be made therein without departing from the invention. Therefore, it is aimed to cover all such changes and modifications as fall within the true scope and breadth of the invention as defined in the claims which follow.

What is claimed is:

1. A swivelable mount and locking mechanism for ski board binding for providing rotational adjustment of said binding about an axis normal to said board, said mount and locking mechanism including:

a) swivelable housing having an upper wall adapted for supporting said binding, side walls, and bottom wall, and enclosing a vertically oriented cavity, and a bore, concentric with said cavity, in said bottom wall, and a generally upwardly-facing annular contact surface adjacent said bore, and wherein the top of said cavity is defined by a generally downwardly-facing surface characterized by an array of radially extending undulations;

b) a support member for swivelably mounting said housing, and adapted to be affixed to said board, and including a cap portion and a stem portion that extends downwardly from said cap portion, said portions being concentric with said housing cavity, and said cap portion rotatably received in said cavity and said stem portion rotatably received in said housing bore, said cap portion having a top surface and a generally downwardly-facing annular contact surface that is disposed in opposition to the upwardly-facing annular surface of said housing;

c) a rotatable pressure plate mounted within said cavity in space above said support member, and having a lower surface that slidably engages the top surface of said support member, and having an upper surface that is characterized by an array of radially extending undulations complementary to said cavity top undulations and slidably engageable therewith, and said plate having a first rotational position in which its undulations are substantially meshed with said cavity top undulations, and said plate being rotatable toward a position in which said arrays of undulations are not meshed; and d) locking means, mounted to said housing, for reversibly rotating said rotatable pressure plate substantially from its first position whereby said plate is moved axially away from said cavity top and said opposing annular contact surfaces are pressed into binding frictional engagement to hold said housing against rotation.

2. Apparatus as defined in claim 1 wherein said opposing annular surfaces are beveled.

3. Apparatus as defined in claim 1 wherein said opposing annular surfaces are scored in a manner to increase their non-slip qualities.

4. Apparatus as defined in claim 1 wherein said plate undulations are six in number.

5. Apparatus as defined in claim 1 wherein said locking means includes a linking element having one end pivotally connected to said pressure plate, and an opposite end connected to means for advancing and withdrawing said linking element relative to said housing.

6. Apparatus as defined in claim 5 including spring means for urging said plate toward its first rotational position.

7. Apparatus as defined in claim 5 including means for releasably securing said advancing and withdrawing means against movement when said plate is rotated substantially from its first rotational position.

8. Apparatus as defined in claim 1 wherein said locking means includes a cam lever including an arm and a cam head, a linking element having one end pivotally connected to said pressure plate and an opposite end pivotally mounted to said cam head, whereby said cam head is slidably engageable, with a wall surface of said housing rotatable to cause movement of said linking element which rotates said plate.

9. Apparatus as defined in claim 8 wherein a hub is connected to said element opposite end, and said hub is rotatably mounted to said cam lever head, and including depressible release mechanism mounted in said cam lever for releasably engaging said hub to hold said lever against rotation relative to said hub.

* * * * *